United States Patent [19]

Snell

[11] 4,084,359

[45] Apr. 18, 1978

[54] SURVEY APPARATUS

[76] Inventor: Thomas Bartlett Snell, Yeovil, England

[21] Appl. No.: 620,424

[22] Filed: Oct. 7, 1975

[51] Int. Cl.[2] ..... E04H 12/34

[52] U.S. Cl. ..... 52/40; 52/119; 52/120

[58] Field of Search ..... 52/111, 115–121, 52/152, 40

[56] References Cited

U.S. PATENT DOCUMENTS

| | | | |
|---|---|---|---|
| 220,031 | 9/1879 | Starr | 52/118 |
| 1,762,740 | 6/1930 | Rains | 52/152 |
| 1,901,726 | 3/1933 | Bonnet | 52/118 |
| 2,474,250 | 6/1949 | Howard | 52/120 |
| 2,581,351 | 1/1952 | Black | 52/116 |
| 2,781,108 | 2/1957 | Selberg | 52/152 |
| 2,812,833 | 11/1957 | O'Nan | 52/117 |
| 2,949,280 | 8/1960 | Curtis | 52/115 |
| 2,998,106 | 8/1961 | Aust | 52/111 |
| 3,109,522 | 11/1963 | Womack | 52/118 |
| 3,185,265 | 5/1965 | White | 52/111 |
| 3,605,359 | 9/1971 | Bader | 52/116 |

FOREIGN PATENT DOCUMENTS

| | | | |
|---|---|---|---|
| 608,777 | 11/1960 | Canada | 52/111 |
| 292,789 | 6/1916 | Germany | 52/116 |

*Primary Examiner*—Ernest R. Purser
*Assistant Examiner*—Henry Raduazo
*Attorney, Agent, or Firm*—Young & Thompson

[57] ABSTRACT

A survey system employs a ground-based extendible mast so that survey instruments, such as cameras, mounted at the top of the mast can attain heights comparable to those of low-level aerial photography. The mast is mounted on a base structure that houses a self-contained power plant, including an internal combustion engine, electric batteries and means for compressing fluid and storing it in a pressurized state. The mast may be telescopic and also tiltable, and the instrument pack at the top may be controlled from ground level to move to selected attitudes, e.g. to pan and tilt.

Simpler versions are described, omitting the power plant and adjustable entirely manually, and one system is carried by an operator rather than being ground based.

2 Claims, 9 Drawing Figures

SURVEY APPARATUS

This invention relates to survey apparatus.

Aerial photography has many and wide applications and the use of aircraft or helicopters as a platform for the camera is known. Aerial photography may be carried out at a great altitude or close to the ground. The apparatus of this invention is primarily, but not exclusively, concerned with the latter. Aircraft are often restricted and are unable to operate below certain minimum heights. Fixed wing aircraft are moving and unable to give continuous visual information of a particular position at a low altitude. Helicopters can remain stationary but are expensive to operate, noisy and a source of vibration for the camera platform, also causing downdraught and consequent inconvenience from the rotor blades.

It is an object of this invention to provide survey apparatus which is ground based, but which can attain a height that gives an effective substitute for aerial photography or other survey work.

According to one aspect of the present invention there is provided survey apparatus comprising a base structure, an extendable and retractable mast carried at its lower extremity by said base structure, an assembly for receiving and/or transmitting signals, visual and/or other, mounted on the extremity of the mast and orientable into selected positions, power means contained within the base structure for powering the movements of said mast and said assembly, and control means for governing the power means and operation of said assembly.

The mast is preferably telescopic and may be operated pneumatically or hydraulically. Also, not only can it be extendable and retractable in this mode, but is may also be pivotally mounted to move between a substantially horizontal stowed position and a substantially vertical operating position. The heel of the mast, in this case, conveniently co-operates with a lead screw and nut assembly, whose operation pivots the mast.

In a preferred form the base structure comprises a base element for securing to the ground or other firm support and a housing adjustably mounted thereon, containing said power means and carrying said mast. The housing may be tiltably mounted on the base element and the tilt can be adjustable by means of another lead screw and nut assembly.

The power means will generally be a combination of various power sources, a principal one being an internal combustion engine, but there also being electrical batteries and a pressurised fluid vessel. The engine can be arranged to charge the batteries and/or the fluid vessel, the latter via a compressor. This means that all the powered parts can be operated by the batteries and/or pressurised fluid, so that the apparatus can operate without the engine running.

The assembly for receiving and/or transmitting signals is conveniently mounted for rotation about two mutually transverse axes and one of them may be parallel to that of the mast; This assembly will generally include at least one camera, film or television, and the rotational movements will correspond to pan or tilting movements of the camera. With a television camera in said assembly, there will generally be an associated monitor screen provided in the control means. In one preferred arrangement, a reflex film camera is included in said assembly and a television camera is focused on its viewfinder.

The camera assembly will generally require a control cable connected to the base structure, and there may be means for releasing and drawing in said cable as the mast is extended and retracted. The cable release means preferably comprises two multi-sheaved assemblies around which the cable is traversed in the manner of a multifold purchase, one multisheave assembly being fixed to the base structure and the other being elastically suspended from the mast base section.

The control means is preferably in a unit separate from the base structure and connectable thereto by a cable. With a television camera being used, there may be means provided for video tape recording the television picture.

The apparatus outlined above can perform many operations and be very versatile. However, it is heavy and bulky and therefore not suited to every type of survey work, particularly where the apparatus has to be set up in remote regions to which it may have to be carried by hand, and where fuel may be scarce.

It is a further object of this invention to provide a cheaper and simplified version of the above survey apparatus, and one which can readily be dismantled into component parts for ease of conveyance.

According to a further aspect of the present invention there is provided survey apparatus comprising a base structure, an extendable and retractable mast carried by said base structure, means for mounting an assembly for transmitting and/or receiving signals, visual and/or other, at the upper extremity of the mast, and a linkage for staying the mast from the base structure, and adjustable to tilt the mast into a desired attitude, the base structure providing stabilising means laterally clear of the mast and linkage.

This apparatus is conveniently dismantleable into component parts of base structure, mast, transmitter/-receiver mounting means, linkage. Preferably the mast is telescopic and is extendable pneumatically or hydraulically, although other extendable arrangements are possible.

In one preferred form, the mast has a base support column and an extendable section. The base support column is mountable on the base structure and is held in position by the linkage, while the extendable section is conveniently pivoted at its lower end to the support column. The latter can be provided with means for drawing the extendable section up into an operative position aligned with the column, the extendable section pivoting at its lower end from an initially horizontal position. This arrangement may be used when the mast, even when fully retracted, is of considerable length and weight and cannot readily be fixed to the base section by being held upright.

The base structure conveniently has a platform for receiving a weight, such as the wheel of a motor vehicle. It may also be adapted to have extension legs attached to enlarge its span and thereby make it free-standing. These legs can have adjustable feet at their free ends.

According to another aspect of the present invention there is provided survey apparatus comprising an extendable and retractable mast, a waist belt with means for locating and supporting the foot of said mast, handles for manual retention and guidance of the mast above said foot, and means for mounting an assembly for transmitting and/or receiving signals, visual and/or other, at the extremity of the mast.

When adapted for photography, this apparatus will preferably include periscope means for viewing the area to be photographed.

The invention may be performed in various ways and some constructional forms thereof will now be described, by way of example, with reference to the accompanying drawings, in which.

Figure 1:
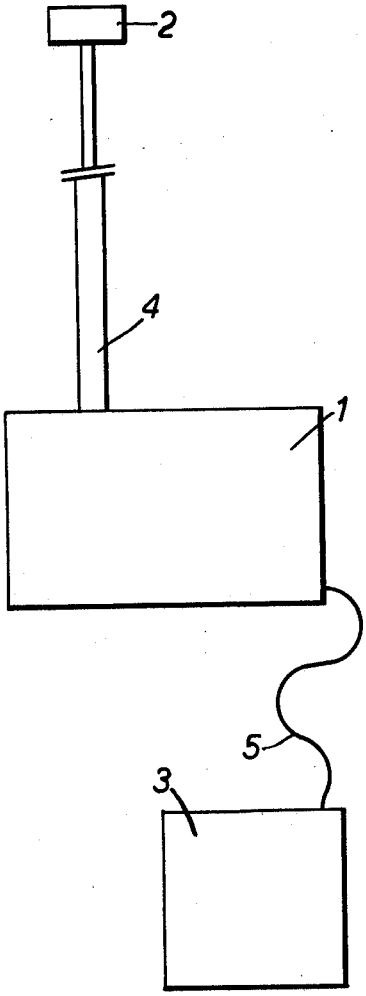
FIG. 1 is a block diagram of the three main components of the survey apparatus.
Figure 5:
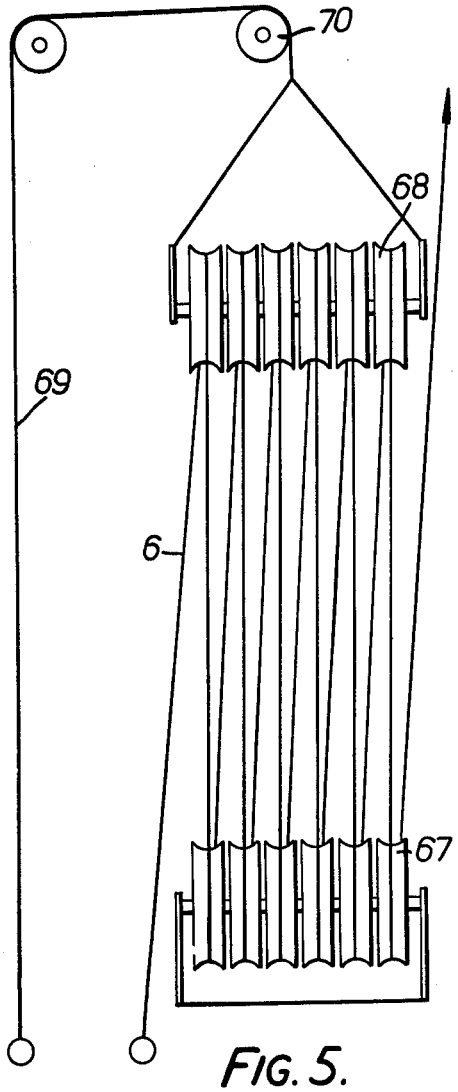
Figure 3:
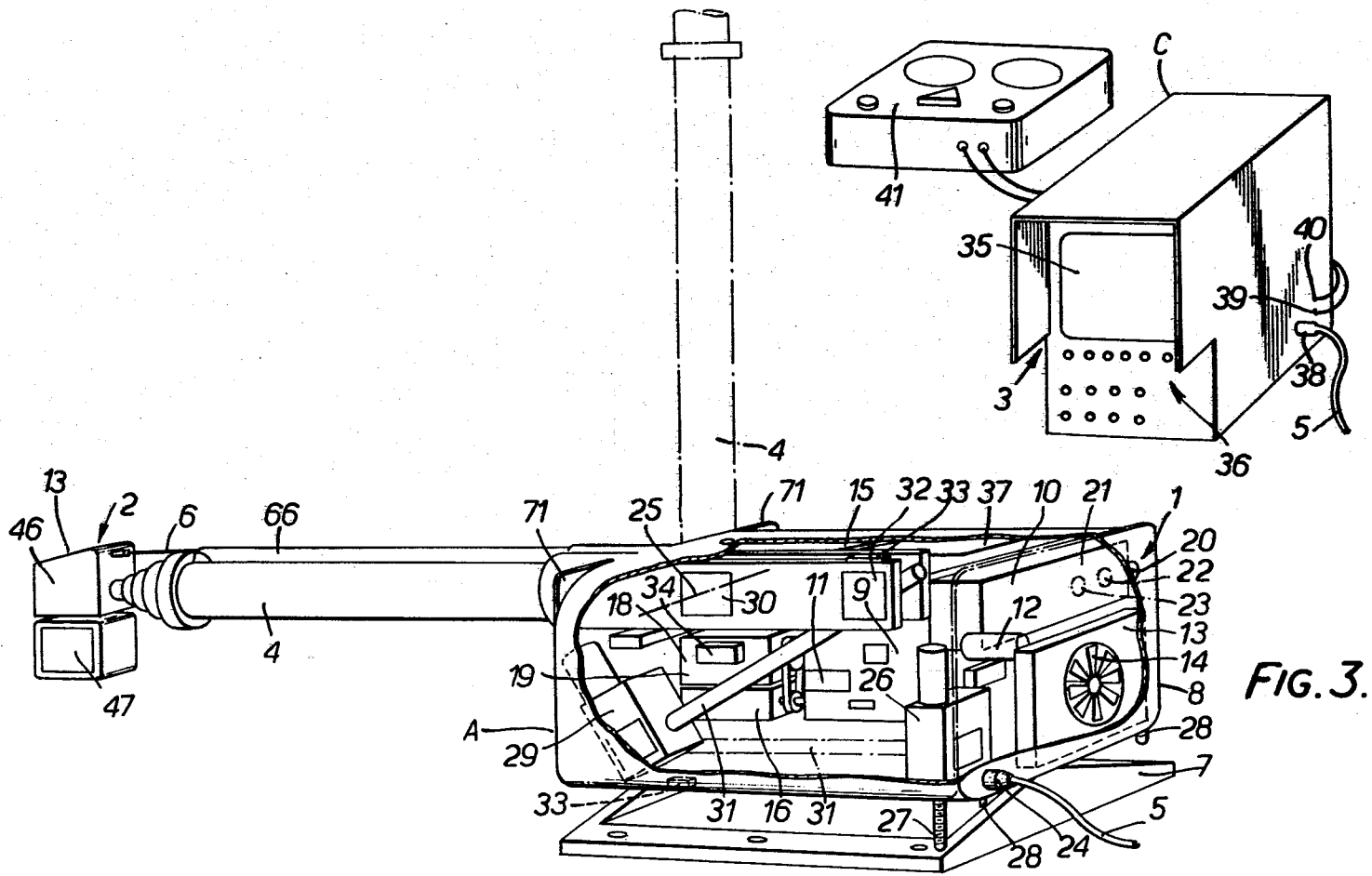
Figure 4:
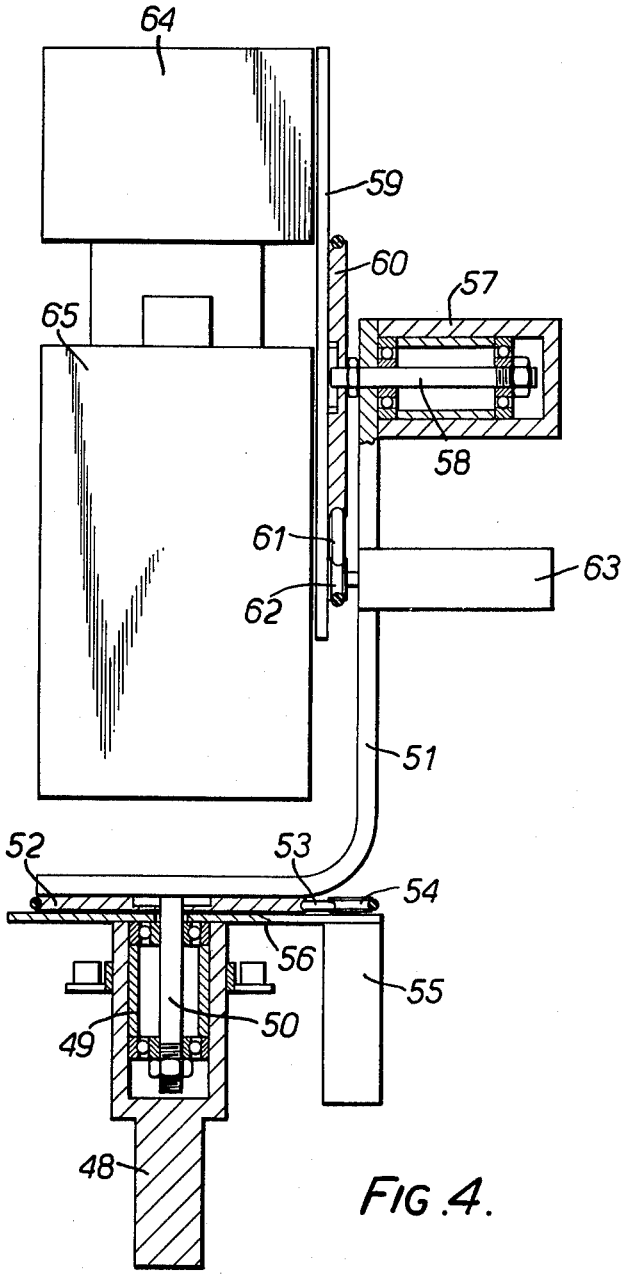
Figure 6:
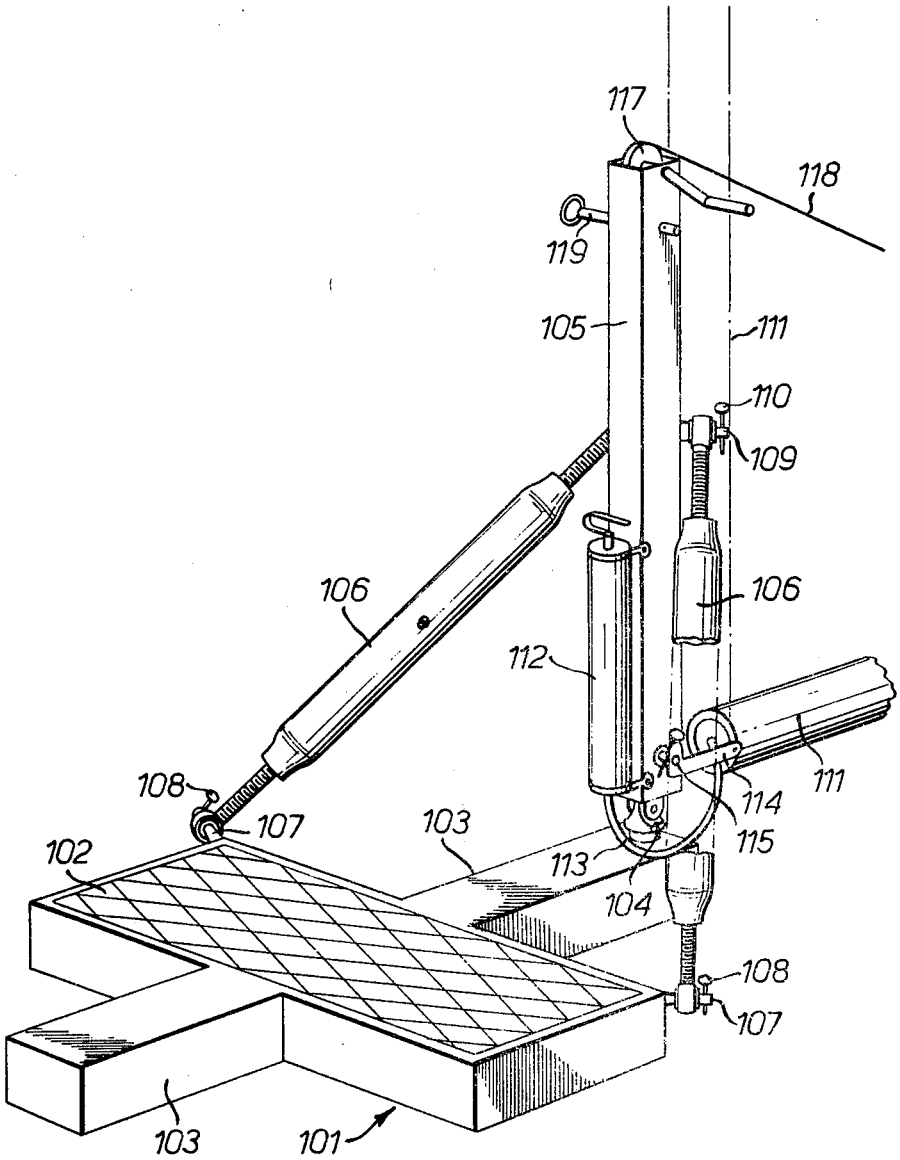
Figure 7:
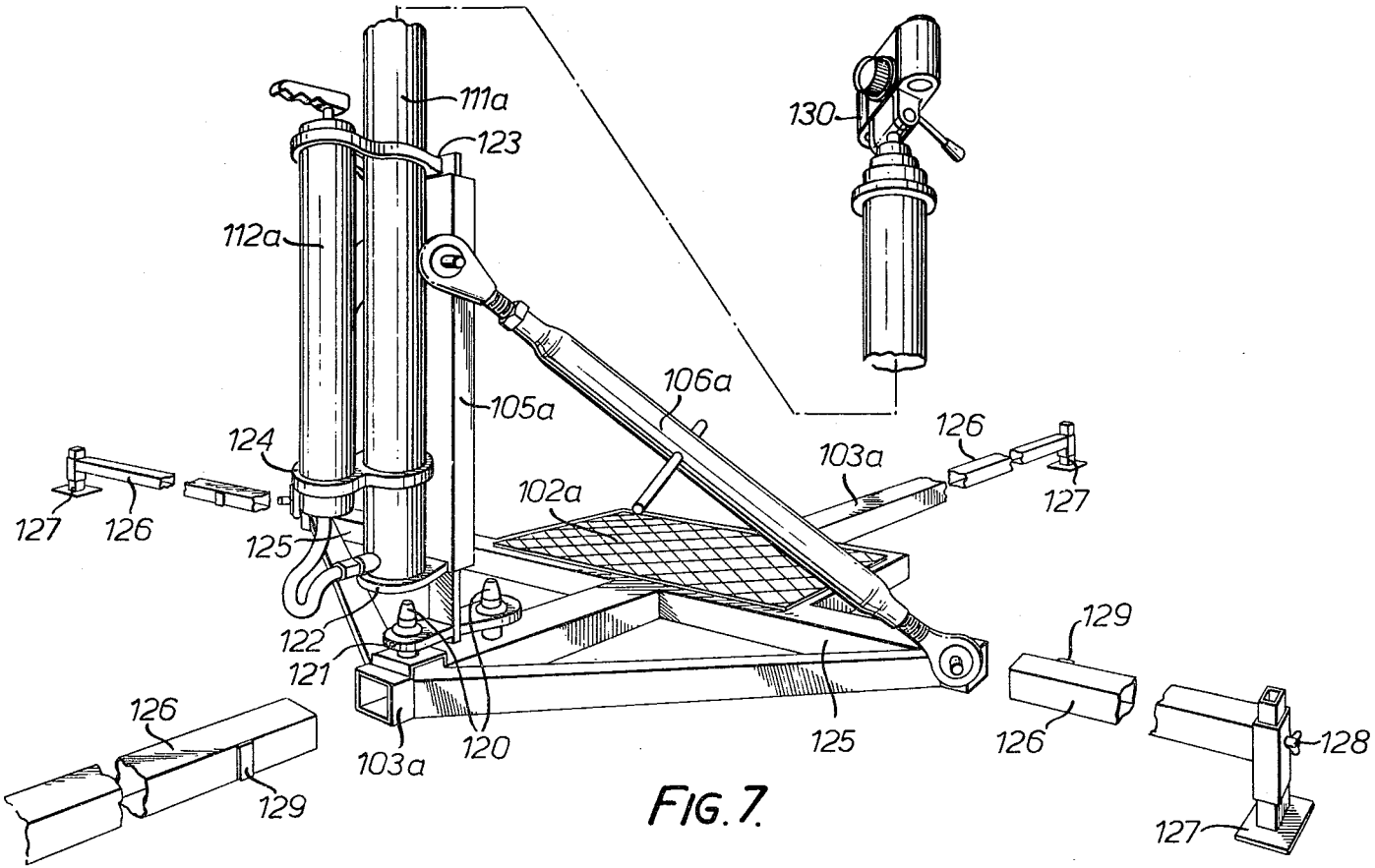
Figure 8:
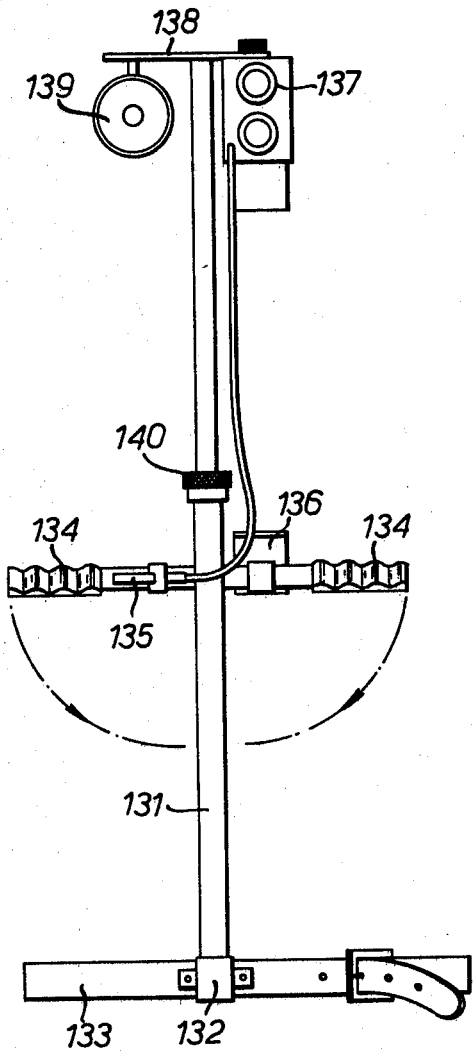
Figure 9:
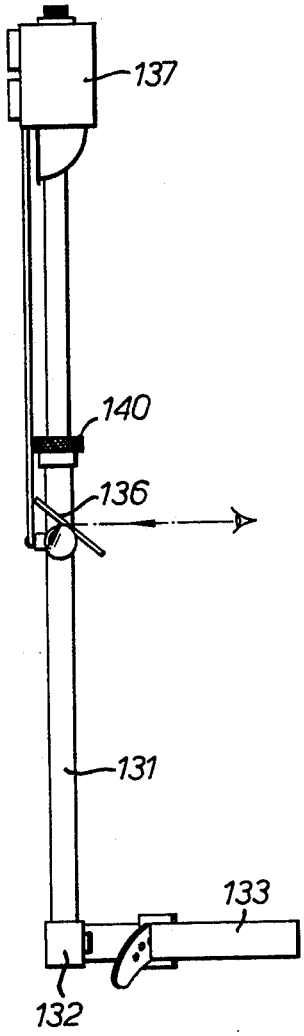

FIG. 3 is a broken away, somewhat diagrammatic, perspective view of the apparatus, FIG. 4 is a partly sectioned elevation of a camera head, FIG. 5 is a diagram of a cable dispenser forming part of the apparatus, FIG. 6 is a diagrammatic perspective view of further survey apparatus according to the invention, FIG. 7 is a similar view of other survey apparatus according to the invention, FIG. 8 is a front elevation of a simplified survey apparatus and, FIG. 9 is a side elevation of the apparatus of FIG. 8.

The survey apparatus comprises three basic components, a mast support and power unit 1, a camera pack 2, and a control and remote display unit 3. The camera pack 2 is carried at the top end of a telescopic mast 4 and can be remote controlled from the unit 3 via a multi-core cable 5 and the power unit 1.

The camera pack may have a single camera, still, cine or television, or a combination of these. It will generally be preferred to have at least one film camera and one television, and with reflex film cameras, the television camera can be arranged to look through the viewfinder and present to the remote display unit the scene on which the film camera is focused. The camera can be selectively equipped with motorised zoom, focusing, iris and other controls, and if there are two or more cameras they can be coupled, e.g. to zoom together, or be independent. In addition the camera pack is arranged to pan and tilt, and one arrangement for achieving this will be described later in connection with FIG. 4. The controls to the camera pack are via a multi-core cable 6 which extends with the mast using a device to be described later with reference to FIG. 5.

Figure 2:
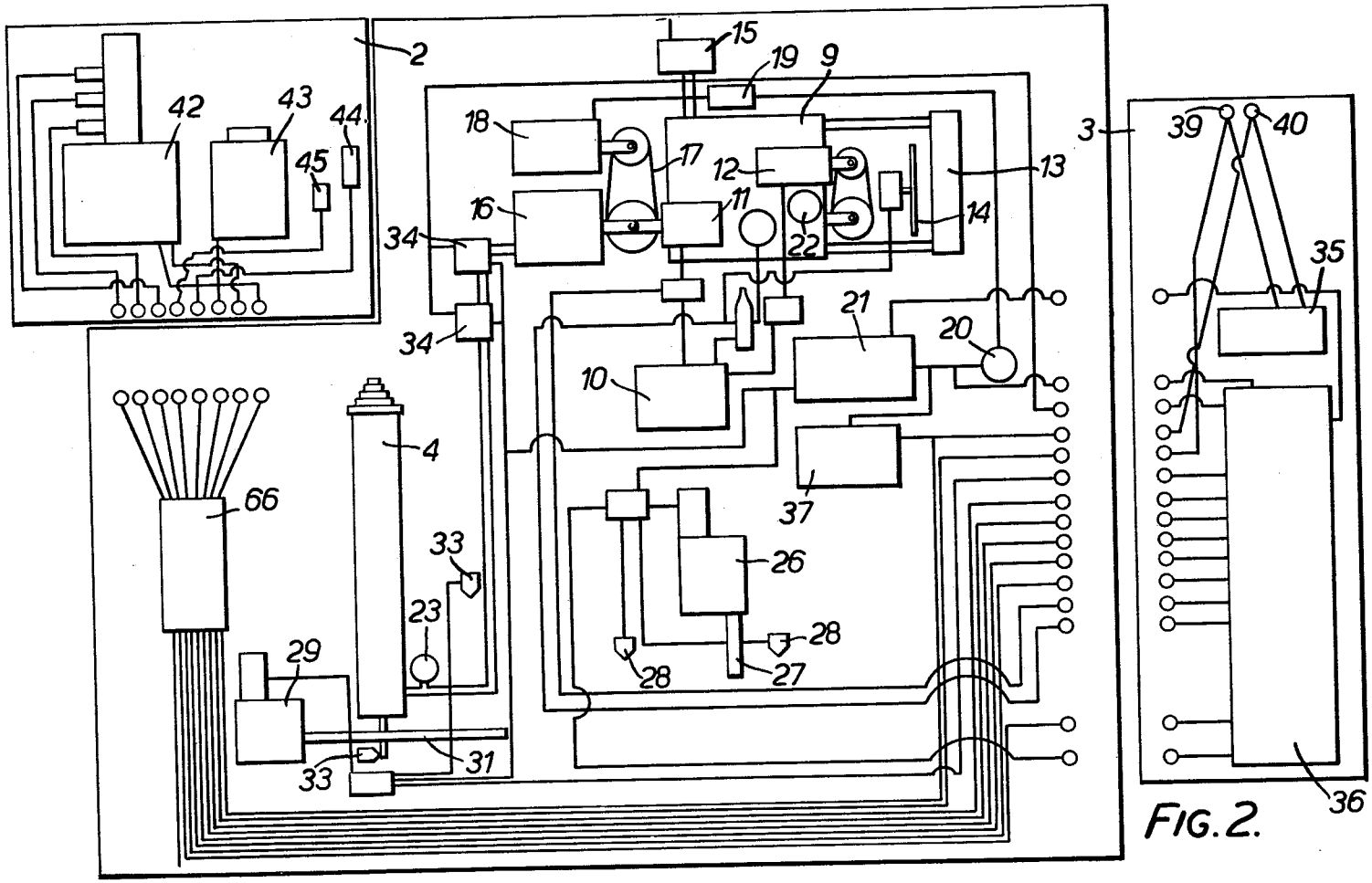
FIG. 2 is a more detailed block diagram of the apparatus.

The mast support and power unit 1 will now be described, its circuitry forming a large part of FIG. 2, and an example of the construction being shown in FIG. 3. The unit has a base 7 which is generally rectangular in plan view and drilled at points along opposite edges for receiving securing bolts. It is formed with a ridge of shallow inverted V-section and to the apex is hinged the base plate of a housing 8. This is also generally rectangular and overlies the base 7, and the hinge along the longitudinal center line of the housing base plate allows the housing to pivot from side to side through a small arc.

Mounted within the housing 8 is an internal combustion engine 9 equipped with the usual ancillaries of battery 10, starter 11, belt driven dynamo 12, radiator 13, fan 14, in this case electrically driven, and fuel tank 15. The engine drives an air compressor 16 and by a belt drive 17 a 24 V alternator 18 which charges, through an associated control box 19 and ammeter 20, a 24 V battery pack 21. The engine is mounted to one side of the housing, with the fuel tank above it and the radiator at one end. This end also has a panel including the ammeter 20, and pressure gauges 22, 23 for engine oil and air respectively, and the multi-core cable 5 from the unit 3 is plugged in at 24.

The remainder of the housing is occupied by the heel of the mast, means for raising and lowering it, and means for tilting the housing with respect of the base. As well as being telescopic, the mast 4 pivots near its heel about a transverse axis 25 perpendicular to the hinge axis so that it can move between the full line horizontal and retracted position of FIG. 3 and the dotted line vertical and extended position. The housing is formed with a slot to receive the swinging heel.

The means for tilting the housing comprises a swinging motor and gear box assembly 26 which drives a nut (not shown) on a lead screw 27, projecting up through the housing base plate from a corner of the base 7. The assembly 26 swings within the housing in order to maintain alignment with the lead screw as the housing tilts, which movement occurs as the nut is turned on the screw. Limit switches 28 are provided on the underside of the housing to co-operate with the base to cut out the motor of assembly 26 when the housing has reached the permitted maximum angle of tilt in either direction. The lead screw and nut arrangement are self-locking; i.e., once the motor is stopped the housing will stay put.

The pivoting of the mast is also carried out by means of a self-locking lead screw and nut. A swinging motor and gear box assembly 29 is pivotally mounted in a corner of the housing, aligned with the mast slot and below the mast bearing 30. The pivotal axis of the assembly 29 is parallel to the axis 25 of the bearing 30. The assembly drives a lead screw 31 which engages in a nut (not shown) spanning the bifurcated lower end of the mast 4. The nut pivots in bearings 32 about an axis also parallel to axis 25. Thus as the lead screw is rotated the nut is drawn towards or driven away from the assembly 29, the mast being raised or lowered accordingly and the pivoting arrangements allowing correct alignment to be maintained. Limit switches 33 are provided within the housing to stop the motor of assembly 29 when the mast reaches either of its two extreme positions. Assuming the base to be horizontal, the lowered position of the mast will also be horizontal, but the permitted upward-swing of the mast will be slightly greater than 90° (i.e., beyond the vertical) so that should the base have to be set at an angle, left hand end down as seen in FIG. 3, the mast can still be set upright. The tilting of the housing 8 will of course ensure that the mast can be set vertical should the base be canted in the lateral direction.

The telescopic mast 4 is extended by feeding compressed air thereto from compressor 16 via Solenoid valves 34. For normal use, when lowered to the horizontal position the mast will be fully retracted first, to avoid undue leverage. However, it is possible to use the apparatus with the mast inclined and extended, thereby to 'overlook' a site. Means can be provided for sensing the leverage at the heel of the mast and cutting out excessive extension and/or incline should this force threaten the stability of the apparatus.

The control and remote display unit 3 includes a monitor screen 35 on which is displayed the picture from the television camera, taken direct or through the viewfinder of another camera. It has a panel 36 on which are all the buttons, knobs or other switch means for comprehensive control of the cameras, mast and power unit. These will not be individually referenced but will include controls for retraction and extension of the mast, the mast pitch angle, video signals, camera shutters, pan and tilt of the camera pack, zoom, focus and iris, engine ignition and start, and housing (and thus mast) tilt. The signals from these controls will be carried by the multi-core cable 5, which will also have lines for the 12 V. and 24 V D.C., outputs of the batteries and for a mains-level A.C. voltage obtainable from an inverter 37 connected to the battery pack 21. The cable 5 plugs in to the unit 3 at 38, and sockets are also provided at 39 and 40 for a video output and the A.C. voltage, whereby a video tape recorder 41 can be used in conjunction with the apparatus.

The camera pack can take many different configurations, as suggested above, and normally the cameras will have parallel focal axes and be arranged to pan and tilt together. The top left hand corner of FIG. 2 illustrates in block diagram form a twin camera arrangement, television (42) and film (43), with pan and tilt motors 44 and 45 and zoom, focus and iris controls on the television camera. As far as consistent with avoiding obscuring any lenses, the cameras can be contained in a weatherproof housing 46 (see FIG. 3) with a transparent screen equipped with a wiper 47. This can also be remote controlled.

Conveniently, the pan and tilt motors are electric, but their coupling to the members they move should as far as possible avoid shock or vibrations being transmitted to the cameras. It is also advantageous to have a drive that will slip in the event of the pack being accidentally allowed to hit an obstruction. Therefore, although gears and friction drives could be used, it is preferred to employ belts. One simple form of camera pack with this form of drive is illustrated in FIG. 4.

An insert 48 plugs into the head section of the telescopic mast and provides a co-axial bearing 49 for a stub shaft 50 projecting downwardly from the underside of an L-shaped bracket 51. This underside also has fixed thereto a large pulley 52, the co-axial with the shaft 50 and coupled by a belt 53 to a small pulley 54. This is driven by a 'pan' motor 55 mounted beneath a plate 56 secured to the top of the insert 48. It wiil be understood that when the motor 55 is energised the bracket 51 will swing at a relatively slow speed about the mast axis. In order not to have wiring (not shown) getting too twisted, there may be limit switches to confine the swing to a given arc.

The vertical arm of the bracket 51 carries at the top a bearing 57 for receiving a stub shaft 58 projecting laterally from a mounting plate 49 for the cameras. This is driven on the same principle as the bracket, having a large pulley 60 driven by a belt 61 from a small pulley 62 on the shaft of 'tilt' motor 63, which is mounted on the bracket 51. Again, there may be limit switches.

The camera arrangement consists of a reflex film camera 64 and a television camera 65 focused on the viewfinder of the camera 64.

The multi-core cable which transmits the control signals to the camera pack has to be long enough to reach to the top of the mast fully extended. This length could be awkward when the mast is retracted, for the cable will have to be neatly stowed. Therefore provision is made for automatically dispensing the cable as the mast is extended and for stowing it upon retraction. At the same time, the use of slip rings, which are normally necessary if a cable is wound up, are avoided. They tend to imperfect contact, and are particularly unsuited to transmitting video signals.

The cable dispenser is illustrated diagrammatically at 66 in FIG. 3 and in more detail in FIG. 5. It consists of two sets of pulley 67 and 68 with the cable 6 traversed around them in the manner of a multi-fold purchase. The lower 'block' 67 is fixed to the housing 8 and the upper one 68 is suspended from a highly elastic shock cord 69 traversed around a pulley 70 at the top of the large diameter base tube of the telescopic mast and anchored to the housing. The cable 6 is plugged at one end into the housing, leads from there to the upper block, and finally from the lower block to the camera pack.

When the mast is fully retracted, the upper block 68 is near the top of the mast base section and the cable is taken up by the multi-fold spans between the blocks. As the mast is extended and more cable is required, so the upper block is pulled nearer the lower one as cable is released. By virtue of the purchase, no great tension is applied to the cable, although the shock cord 69 will be considerably tensioned. The cable will be drawn back onto the expanding blocks as the mast is retracted.

The operation of this apparatus will be largely apparent from the foregoing description. The independent power unit can be placed almost anywhere that provides a secure base, on a fixed steel or wooden structure, on the ground, or on vehicles or trailers. To aid positioning and removal the housing is provided with apertured lifting lugs 71 at the four upper corners. If the base cannot be bolted or spiked down, ballasting, e.g. with heavy stones or sandbags, may be sufficient. To aid levelling, the top of the housing may be provided with built-in indicators. It may be used on board ship, but staying of the mast will then probably be required. Additionally, however, provision may be made for gyroscopically governing the camera pack or the complete mast pack to maintain the cameras on target and the mast in a desired attitude.

The power requirements are not great, and the engine size is preferably selected so that it is not expected to run at much more than 'tick-over' speed. This reduces the vibration and noise problem. The apparatus can be, however, designed to be operable without the engine running, which can be used merely to charge the batteries and, via the compressor, one or more air bottles (not shown). If necessary the air bottles can be recharged using electric battery power. Thus the mast can be extended and the cameras used silently and without vibration. This may be useful indoors, such as in exhibition halls, where engines cannot be run. In order to avoid freezing of moisture in the mast, the air line may have means for introducing an anti-icing agent.

One particular arrangement of the cameras is for photogrammetry or stereo photography. The mast and/or the pan and tilt head can in addition, or alternatively, be employed to carry equipment other than cameras. For example, it may carry radio antennae (directional ones can usefully have their direction adjusted) or a searchlight. The mast head may also carry a flashing beacon and research instruments e.g. pollution sensors.

In further refinements of this apparatus, radio control may be used, instead of control means connected by land line, and a programme may be applied to the control unit so that the apparatus performs a predetermined sequence of events. The apparatus may also be simplified to a certain extent by incorporating all the controls in the housing 8.

While pneumatic extension of the mast and electrically driven lead screws or nuts and pan and tilt motors have been described, it will be understood that other means can be employed. For exaple the mast may be hydraulically expandible, or mechanically, and hydraulic or pneumatic means may be used for swinging the mast between vertical and horizontal positions, augmented if necessary with means for locking the mast in set positions. The pan and tilt motors can be pneumatic, and the lines therefor can be drawn out from a cable dispenser as described. These would be very satisfactory as an anti-vibration and shock measure.

Another control not previously mentioned is that for film advance for a still camera. This may be separate, or preferably combined with the shutter control, so that after each 'shot' the film will be automatically advanced.

As an example of dimensions, the mast may attain an extended length of the order of 70 ft., which for most purposes will give, in effect, aerial photography. As mentioned aboe, it can be used in an inclined attitude, and in strong winds it may be advisable to have it leaning into the wind. The mast could be stayed if really necessary.

Somewhat simpler apparatus will now be described with reference to the remaining Figures.

The apparatus of FIG. 6 has a base structure 101 including a rectangular platform 102 with two stabilising arms 103 projecting from the centers of the two loner sides of the platform. This base structure is of rugged construction, and is designed to take the wheel of a moderately heavy vehicle, such as a Land Rover. At the end of one of the arms 103 there is a universal or Hooke joint 104 providing the mounting for a mast support column 105 which can be removed, with or without the universal joint 104, from the base structure. The mast support column 105 is also of rugged construction, for example a box section steel girder. It is supported by two bottle or rigging screws 106 which act as stays between the two adjacent corners of the platform 2 and points about half way up the column 105 but not necessarily each at the same height as shown. The platform corners are provided with projecting studs 107 onto which eyes on the ends of the screws 106 fit, being held there by locking pins 108. Studs 109 also project from the column 105 and the eyes at the other ends of the screws 106 fit onto them and are held by locking pins 110. The eyes are equipped with spherical bearings to accommodate the mast being tilted by extension or retraction of one or both of the bottle screws, which in plan view extend substantially at right angles to one another.

An extendable mast 111 is pivotally mounted on the support column 105, and can be hoisted into a position aligned therewith. The mast is telescopic and can be extended pneumatically by means of a hand pump 112 mounted along the mast support column 105, with a flexible connecting pipe 113 to the mast. The pivot arrangement for the mast comprises a bracket 114 fixed to the lower end of the outermost tube and embracing the bottom column 105, with a pivot pin 115 inserted through the bracket 114 and column 105 and retained there by a locking pin. Thus the mast can pivot between the horizontal full line position shown and the upright dotted line position aligned with the column 105. To carry this out, the upper end of the mast support column 105 is equipped with a hand-operated winch 117 whose cable 118 can be shackled or otherwise secured to a point on the mast 111. When hoisted upright a locking bar 119 is slid transversely through a fitting (not shown) on the outermost tube of the telescopic mast and can be locked there by a small transverse pin (also not shown).

The innermost tube of the telescopic mast will be equipped at its free extremity with means for mounting a camera pack or other signal transmitting or receiving apparatus, such as described above. There may also be provided a cable dispenser as described. When a television camera, is used, there will also be a conrol unit and battery power as previously described, although it will not need to have the controls for altering the attitude of the mast, or its height. That will be done manually. The camera pack may be simplified to a single camera, preferably a single lens reflex one, and provision for pan and tilt may be discarded. To keep the pan direction to that set on the ground, the telescoping tubes may be keyed or splined, thus preventing mutual rotation as they are extended. The camera can then be pre-set on the ground to what is thought will be the correct attitude when the mast is raised. With a Polaroid camera the results can be checked immediately. Alternatively, a wide angle lens camera may be used to ensure that the subject is "shot". As an aid to correct positioning and when the area to be photographed is accessible, the camera pack may have sighting bars or other marks which can be aligned by observation from the centre of that area. The camera(s) will then have the desired attitude. The camera(s) can be operated by mechanical means, such as Bowden cables, or an air release system, or electrically as by solenoids.

Instead of splining the tubes, which is expensive, it is possible to leave them plain cylindrical and to adjust the pan angle when the mast is extended by manually twisting the second largest tube, as described below with reference to FIG. 7.

The apparatus is assembled by first placing the base structure 101 on the ground and ballasting it, for example by manoeuvring a vehicle so that one wheel rests on the platform 102. The mast and bottle screw stays are all to one side of the platform for this purpose. The lower ends of the bottle screws 106 are then fitted to the studs 107 and the mast support column 105 is mounted by the universal joint 104 on the projecting arm 103 and held in position while the upper ends of the bottle screws are fitted to the studs 109. The telescopic mast 11 is then fitted by its pivot pin 115, the cable 118 is attached, and the winch 117 is oprated to wind the mast up into an aligned position with the column 105, where it is held by bar 119. Locking pins are inserted as necessary. The camera pack may be mounted while the mast 111 is still in the horizontal position or raised a few feet. It would, however, be possible to provide a ladder or steps to enable the mounting of the camera pack to be carried out when the mast is upright. It is then extended as necessary by operation of the pump 112. There is also a relief valve (not shown) for bleeding the mast to retract it.

FIG. 7 shows a slightly simplified version of the apparatus of FIG. 6, and like parts are similarly referenced, but with the suffix *a*.

The main respects in which it differs are that the mast **111*a* is held rigid with the support column 105*a***, and the latter pivots only in one direction on the base. It is a lighter piece of equipment, and the fully retracted mast and column can be readily raised by hand into the vertical position and mounted on the base.

In more detail, instead of a universal joint mounting, one of the arms **103*a* of the base has two upstanding studs 120 onto which fit spherical bearings provided in a ase plate 121 at the bottom of the column 105***a*. This may be locked in position by pins (not shown). the mast is held to the column 105*a* by a bracket 122 at the bottom and a clamping strap 123 at the top, which also holds the hand pump 112*a* to the mast on the opposite side to column 105*a*. A further strap-lik clamp 124 holds the bottom of the pump. The mast is again supported by bottle or rigging screws 106*a* (only one of which is clearly visible) and their lower ends are attached not to the corners of the platform 102*a* but to the ends of arms 125 extending therefrom at right angles to the arms 103*a*.

The mast cannot tilt to any significant degree in the vertical plane containing the arms 103*a*. However, the spherical bearings in the base plate 121 which cooprate with the up-standing studs 120 make it feasible for the mast to be tilted at right angles to that plane and parallel to the vertical plane containing the arms 125. As with FIG. 6, this tilting can be controlled by adjusting the bottle screws 106*a*, which are substantially at right angles to one another.

As with FIG. 6, the base can be stabilised by a weight, such as a wheel of a vehicle, on the platform, which is laterally clear of the mast and bottle screws. It can also be stabilised by extension arms 126 which telescope into the arms 103*a* and 125. At the free ends of these telescoping arms there are adjustable feet 127 which can be clamped in desired positions by thumbscrews 128. The extent of insertion into the arms 103 and 125 is limited by stops 129. The base can then be left free-standing.

The base structure of FIG. 6 may also be adapted to be fitted with such extension legs; indeed the base structures may be identical giving just a choice of alternative masts.

With this apparatus as used for photography, the upper end of the mast 111*a* will normally carry a single camera 130 which will be set to the desired degree of tilt before the mast is extended. The pan can be adjusted by manually turning the second largest of the telescoping tubes after extension. It may be ncessary toclimb on the mast support column 105*a* to do this, and the latter may be provided with rungs or steps to assist the operator. Alternatively separate steps can be used. The operation of the camera will be carried out pneumatically, mechanically, or electrically, as described above.

In high winds, the masts of the embodiments described will tend to sway when fully extended and therefore provision will be made to enable wire or rope stays to be attached at the top and/or at intermediate points. They may be anchored at their lower ends by tying to suitable fixed objects or they may be secured to the ground, as by tent pegs.

It will be understood that the bottle screws may be replaced by other means, such as hydraulic cyliners and the hand pump 112 may be powered. The telescopic masts could be extended hydraulically instead of pneumatically. There could also be masts designed to be extended mechanically, for example using wire or rope in the manner of extension ladders. The winch for hoisting the mast of FIG. 6 may also be replaced by other means, such as a hydraulic piston and cylinder actuator. The power supply can be obtained from the vehicle used to transport the equipment and, in some cases, to stabilize it in use.

FIGS. 8 and 9 show an even more simplified version. This is to be carried entirely by the operator, and it comprises a two-part telescopic mast 131 with the base of the large tube received in a pocket 132 on a waist belt 133 in the manner of the staff of a standard bearer. Near the upper end of the large tube there are handles 134 which can be swung between the horizontal operative positions shown and inoperative positions alongside the mast. One of the handles is equipped with a trigger 135 for operating the camera, and the other is fitted with an angled mirror 136 which forms, with another mirror (not shown) or the viewfinder system of the camera 137, a periscope. The camera is fixed to a bracket 138 at the top of the inner tube, and this bracket can also serve to carry other equipment such as a flash light 139. The inner tube is extended simply by being pulled from the outer tubes, and it can be locked at any desired height by a clamping nut 140. It will be understood that there could be more than two telescoping tubes, and that they could be extended pneumatically or hydraulically. For example, the handles may serve to operate an air pump, and the operator could increase the mast height as he views through the camera via the mirror 136 by 'pumping' the handles up and down.

In operation panning is achieved by the operator turning to the direction required and he can also incline the mast to alter the tilt angle.

The use of such apparatus may extend to many fields, including industrial photography, traffic control, archaeological and scientific surveys, military surveillance, movie making, security observations, fire control and marine surveillance. The masts could also carry lamps for transmitting visual signals or aerials for transmitting and/or receiving radio signals.

Further adaptions could make the apparatus suitable for dropping by parachute. The units would require to be mouned on a shock absorbing platform or in a protective container.

I claim:

1. Survey apparatus comprising a base structure, a telescopic mast carriable by said base structure at a position which leaves the base structure with a substantial ballast supporting zone to one side of the mast, means for mounting an assembly for transmitting and/or receiving signals, visual and/or other, at the upper extremity of the mast, and a rigid mast staying and tilt adjusting linkage between the base structure and mast and including two transversely oriented lead screw mechanisms by which the mast can be tilted into a desired attitude in more than one vertical plane, the mast having a base support column and an extendable section, the base support column being mountable on the base structure and held in position by said linkage, the extendable section being carried by said column, the bottom of the extendable section being pivotally attached to the support column, and means on said column for drawing the extendable section up into an operative position with the extendable structure pivoting at its lower end.

2. Apparatus as claimed in claim 1, wherein the apparatus is dismantleable into component parts of base structure mast, transmitter/receiver means, and linkage.

* * * * *